US010238248B2

(12) United States Patent
Pham

(10) Patent No.: US 10,238,248 B2
(45) Date of Patent: Mar. 26, 2019

(54) FOOTSTOOL FOR BATHROOM TOILET TO CORRECT USER'S TOILET POSTURE

(71) Applicant: Duc Van Pham, Princeton, IL (US)

(72) Inventor: Duc Van Pham, Princeton, IL (US)

( * ) Notice: Subject to any disclaimer, the term of this patent is extended or adjusted under 35 U.S.C. 154(b) by 0 days.

(21) Appl. No.: 15/899,655

(22) Filed: Feb. 20, 2018

(65) Prior Publication Data

US 2018/0168412 A1 Jun. 21, 2018

Related U.S. Application Data

(63) Continuation-in-part of application No. 29/586,717, filed on Dec. 6, 2016, now Pat. No. Des. 812,920.

(51) Int. Cl.
*A47K 17/02* (2006.01)
*A47C 16/02* (2006.01)

(52) U.S. Cl.
CPC ..... *A47K 17/028* (2013.01); *A47C 16/025* (2013.01)

(58) Field of Classification Search
CPC ..... A47K 17/028; A47C 16/025
USPC ..... 4/254, 667
See application file for complete search history.

(56) References Cited

U.S. PATENT DOCUMENTS

2013/0067649 A1* 3/2013 Rane ..... A47K 17/028 4/254
2017/0258652 A1* 9/2017 Latham ..... A47K 17/028 4/667

* cited by examiner

*Primary Examiner* — Tuan N Nguyen

(57) ABSTRACT

A footstool for bathroom toilet includes a platform, a first leg assembly, and a second leg assembly. The first leg assembly and the second leg assembly each include a base leg, an outer tubular leg, an inner telescopic leg, a height adjustable mechanism, and an angle adjustable mechanism. The base leg is hingedly connected to the outer tubular leg at each end. The inner telescopic leg is slidably engaged with the outer tubular leg through the height adjustable mechanism that enables the footstool to attain different height levels. The platform that allows the user to place and rest their feet is terminally positioned and connected to the inner telescopic leg of the first leg assembly and the second leg assembly, opposite of the outer tubular leg of the first leg assembly and the second leg assembly.

10 Claims, 6 Drawing Sheets

FOOTSTOOL FOR BATHROOM TOILET TO CORRECT USER'S TOILET POSTURE

The current application is a continuation-in-part (CIP) application of the U.S. design application Ser. No. 29/586,717 filed on Dec. 6, 2016.

FIELD OF THE INVENTION

The present invention relates generally to a footrest. More specifically, the present invention is a footstool for bathroom toilet to correct user's toilet posture for better elimination and colon health.

BACKGROUND OF THE INVENTION

Humans use generally use two types of defecation postures, squatting or sitting, to defecate. More specifically, humans use the squatting posture when using squat toilets or when defecating in open in absence of toilets. On the other hand, humans use the sitting posture when using pedestal or throne type toilets that are also known as western-style flush toilets, wherein the users generally lean forward or sit at 90-degrees with respect to the toilet. As a result of the sitting posture, the natural path of our intestine tends to get pinch or block. In the worst case, this can lead to constipation, irritable bowel syndrome, hemorrhoids, or intestinal cancer. Even though many different existing foot stools are available to overcome this problem, each one of these foot stools only provide elevation for feet and/or angular feet placement within the apparatus.

It is therefore an objective of the present invention to provide a multi-functional footstool for toilet. More specifically, the present invention provides a designated area for the user to elevate their feet above ground, a height adjustable mechanism to increase or decreases to height between the user's feet and the bathroom floor, integrated access to toilet paper, and angle adjustment mechanism to optimize the feet placement. Due to the components and their configuration, the present invention able to achieve squatting posture along with the western-style flush toilet thus allowing natural way of defecation process take place for complete elimination.

DETAIL DESCRIPTIONS OF THE INVENTION

All illustrations of the drawings are for the purpose of describing selected versions of the present invention and are not intended to limit the scope of the present invention.

The present invention is a footstool for bathroom toilet to correct user's toilet posture for better elimination and colon health. More specifically, the present invention enables the user to achieve a squatting posture for the western-style flush toilet that generally allows a sitting posture. As a result, the present invention is able to create a natural way of defecation process take place for complete elimination while utilizing the western-style flush toilet.

Figure 1:
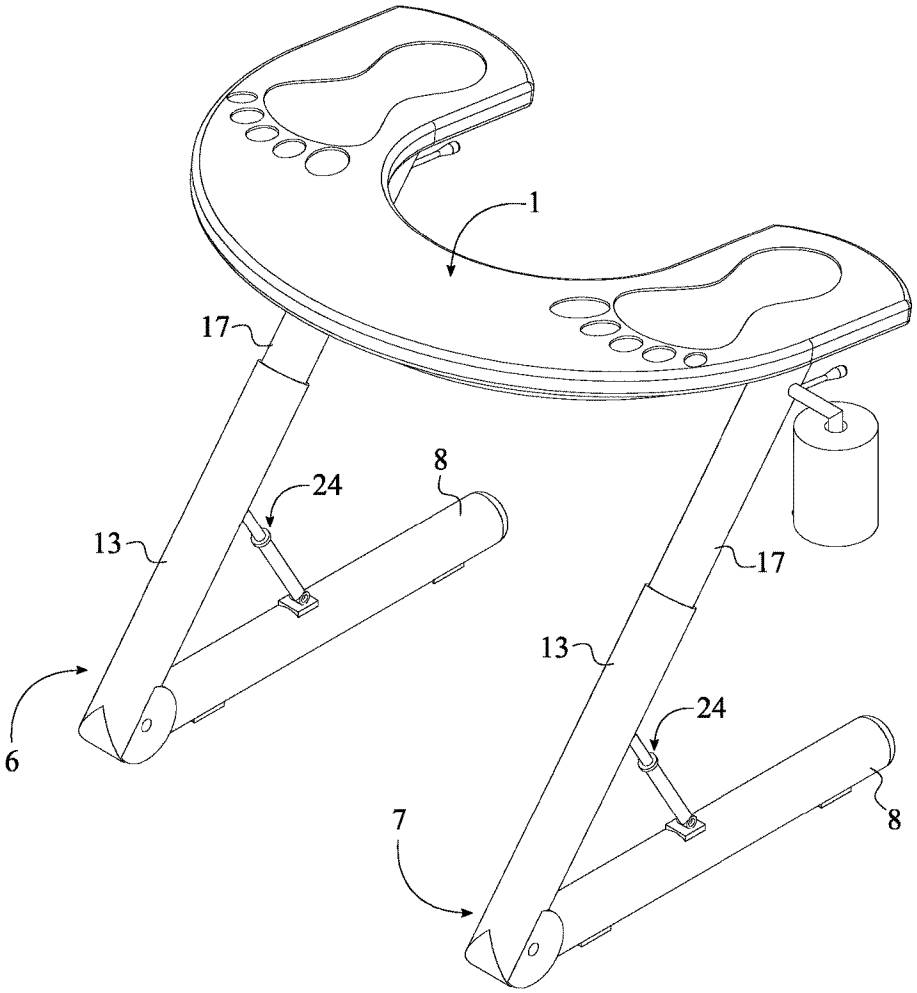
FIG. 1 is a front top perspective view of the present invention.
Figure 2:
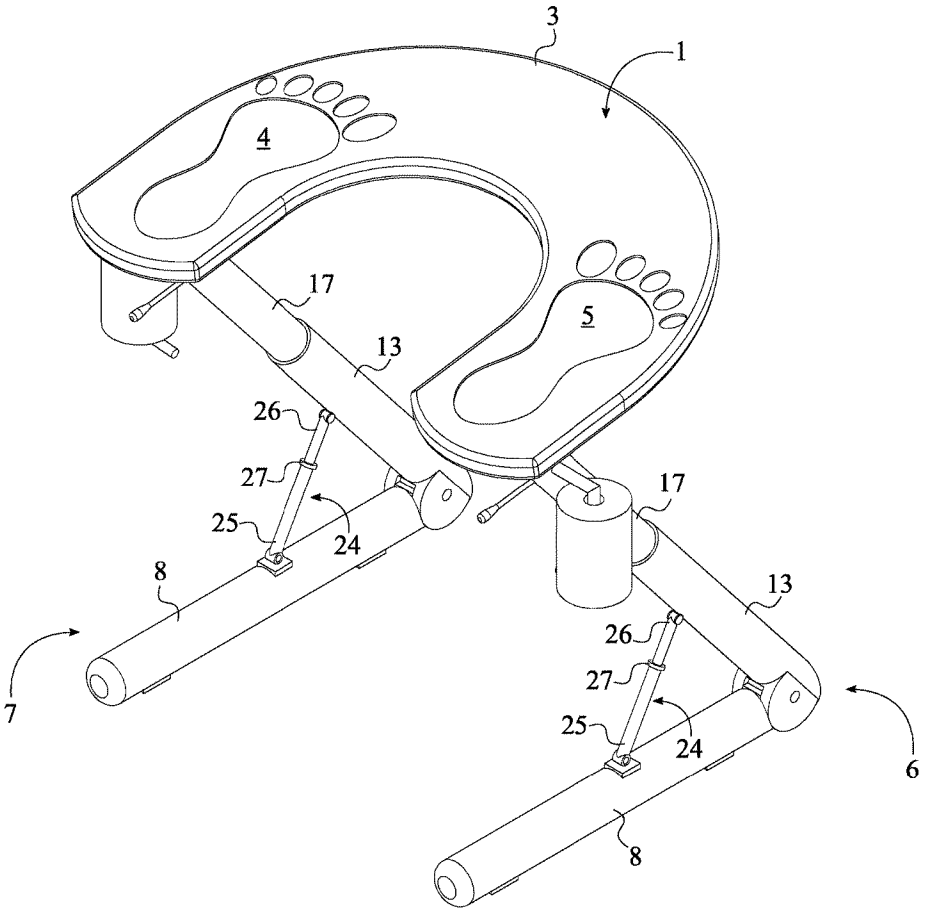
FIG. 2 is a rear top perspective view of the present invention.
Figure 3:
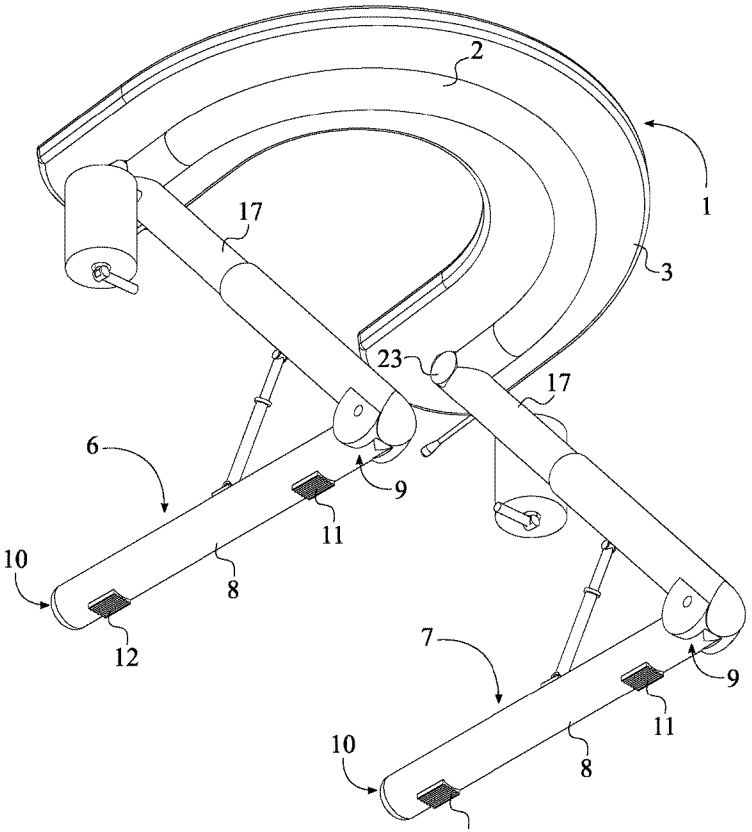
FIG. 3 is a front bottom perspective view of the present invention.

The present invention comprises a platform 1, a first leg assembly 6, a second leg assembly 7 as shown in FIG. 1-3. The platform 1 provides an elevated surface within the present invention so that the user is able to place their feet. The first leg assembly 6 and the second leg assembly 7 are connected to the platform 1, providing elevation and stability for the platform 1. The first leg assembly 6 and the second leg assembly 7 each comprise a base leg 8, an outer tubular leg 13, an inner telescopic leg 17, a height adjustable mechanism 18, and an angle adjustable mechanism 23 to optimize the functionality of the present invention. In reference to the general configuration of the present invention, a front end 9 of the base leg 8 is hingedly connected to a lower end 14 of the outer tubular leg 13 at an acute angle 16. The inner telescopic leg 17 is slidably engaged with an upper end 15 of the outer tubular leg 13 through the height adjustable mechanism 18. The platform 1 is terminally positioned to the inner telescopic leg 17 of the first leg assembly 6 and the inner telescopic leg 17 of the second leg assembly 7. Furthermore, the platform 1 is positioned opposite of the upper end 15 of the first leg assembly 6 and the upper end 15 of the second leg assembly 7. Resultantly, the platform 1 is mounted to the inner telescopic leg 17 of the first leg assembly 6 and the inner telescopic leg 17 of the second leg assembly 7 by the angle adjustable mechanism 23.

Figure 6:
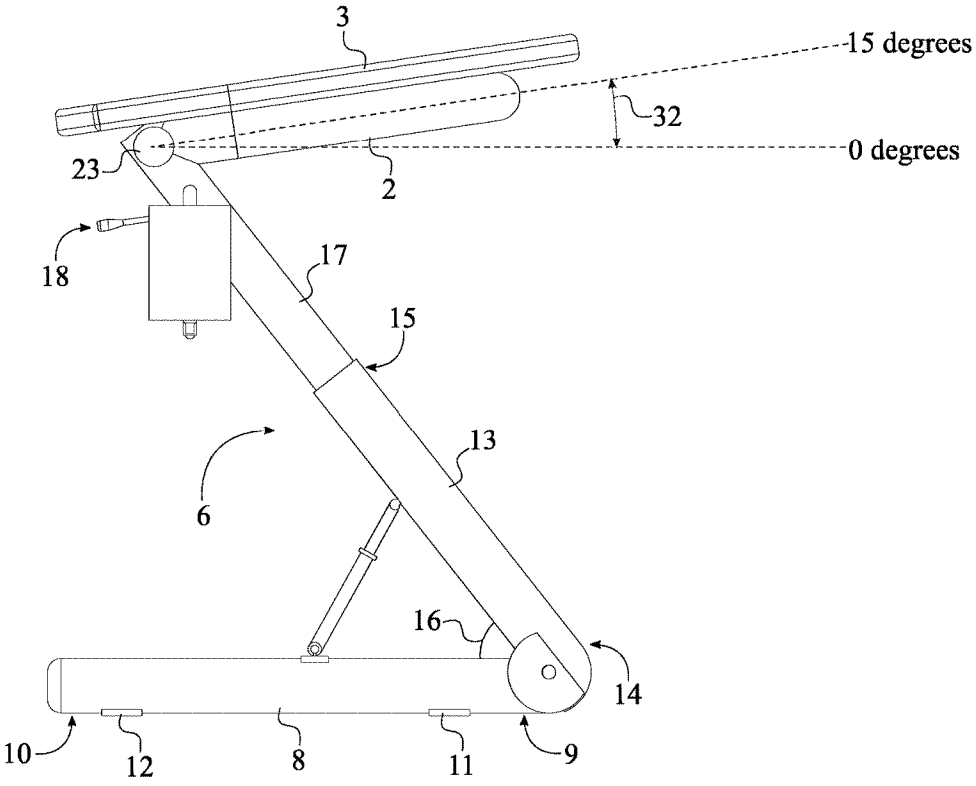
FIG. 6 is a side view of the present invention, showing the acute angle between the base leg and the outer tubular leg and the orientation angle.

In reference to FIG. 6, the base leg 8 positioned along the bathroom floor and functions as the base structural body of the present invention as the rest of components are configured onto the base leg 8. The base leg 8 is an elongated body that comprises the front end 9 and a rear end 10. The outer tubular leg 13 functions as the first vertical structural body within the present invention in order to elevate the platform 1 above the bathroom floor. The outer tubular leg 13 is an elongated sleeve body and comprises the lower end 14 and the upper end 15. More specifically, the front end 9 of the base leg 8 is hingedly connected with the lower end 14 of the outer tubular leg 13 so that the first leg assembly 6 and the second leg assembly 7 can be folded about the hinged connection. However, the hinged connection between the front end 9 of the base leg 8 and the lower end 14 of the outer tubular leg 13 is limited to the acute angle 16. In other words, the hinged connection between the front end 9 of the base leg 8 and the lower end 14 of the outer tubular leg 13 is limited to a rotational movement that ranges from zero degree to 90 degrees. The rear end 10 of the base leg 8 functions as a free end within the first leg assembly 6 and the second leg assembly 7. When the present invention is positioned in front of the western-style flush toilet, the rear end 10 of the base leg 8 is laterally positioned to the western-style flush toilet as the front end 9 of the base leg 8 is positioned towards the front of the western-style flush toilet.

In reference to FIG. 3 and FIG. 6, the present invention further comprises a front friction pad 11 and a rear friction pad 12. More specifically, the front friction pad 11 is positioned adjacent to the front end 9 of the base leg 8. The rear friction pad 12 is positioned adjacent to the rear end 10 of the base leg 8. The front friction pad 11 and the rear friction pad 12 are externally connected onto the base leg 8 to improve the friction between the present invention and the bathroom floor. As a result, the present invention provides a non-slip first leg assembly 6 and second leg assembly 7 thus preventing accidental slippage improving the safety parameters of the present invention.

In reference to FIG. 2, the present invention further comprises a locking brace 24. When the hinged connection between the front end 9 of the base leg 8 and the lower end 14 of the outer tubular leg 13 is extended beyond zero degrees, the locking brace 24 allows the user to secure the base leg 8 and the outer tubular leg 13 in place. More specifically, the locking brace 24 comprises a first support 25, a second support 26, and a locking mechanism 27. The first support 25 is hingedly connected to the base leg 8. The second support 26 is hingedly connected to the outer tubular leg 13. The first support 25 and the second support 26 are pneumatically coupled with each other through the locking mechanism 27. Resultantly, first support 25 and the second support 26 slide within one another or traverses into one another when the acute angle 16 between the base leg 8 and the outer tubular leg 13 changes. Once the desired angle is attained by the user, the first support 25 and the second support 26 can be locked into each other by the locking mechanism 27 to maintain a stationary position for the base leg 8 and the outer tubular leg 13. For example, the first support 25 and the second support 26 function similar to a gas spring. The locking mechanism 27 functions similar to a twist locking member that can easily lock the first support 25 and the second support 26 in multiple positions. As a result, once the desired angle is attained within the acute angle 16, the twist locking member can secure the base leg 8 and the outer tubular leg 13 in place.

Figure 5:
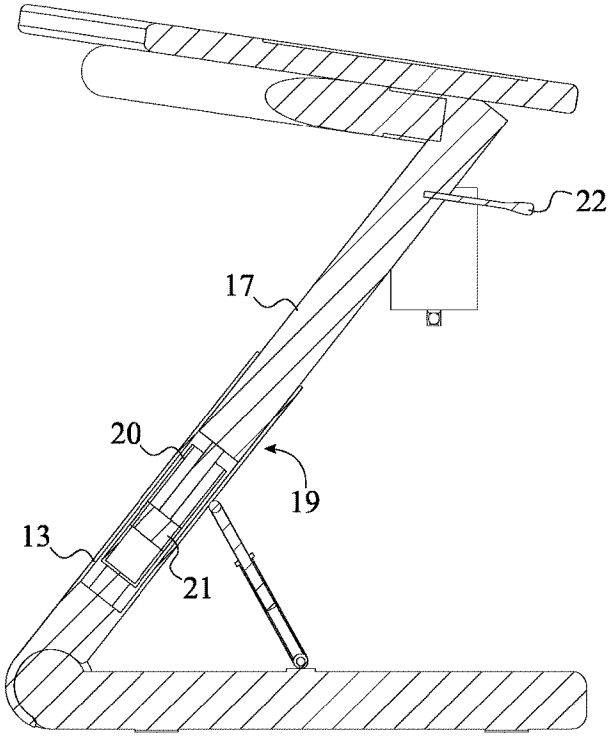
FIG. 5 is a cross section view of the present invention along line A-A of FIG. 4, showing the height adjustable mechanism.

In reference to FIG. 5, the inner telescopic leg 17 functions as the second vertical structural body within the present invention in order to elevate the platform 1 above the bathroom floor in conjunction with the outer tubular leg 13. More specifically, the inner telescopic leg 17 slides in and out of the outer tubular leg 13 allowing the user to adjust the height of the platform 1. Even though the inner telescopic leg 17 is able to retract and extend about the upper end 15 of the outer tubular leg 13, the height adjustable mechanism 18 locks the inner telescopic leg 17 and the outer tubular leg 13 in place once the desired height is attained by the user.

In reference to FIG. 5-6, a preferred embodiment of the height adjustable mechanism 18 comprises a pneumatic lifting assembly 19 and an actuator 22. More specifically, a stator cylinder 20 of the pneumatic lifting assembly 19 is concentrically connected within the outer tubular leg 13. A linear actuated piston 21 of the pneumatic lifting assembly 19 is concentrically connected within the inner telescopic leg 17. The stator cylinder 20 and the linear actuated piston 21 are pneumatically coupled with each other. The pneumatic lifting assembly 19 functions similar to a gas spring so that the inner telescopic leg 17 is able to retract and extend about the upper end 15 of the outer tubular leg 13 upon controlling of the actuator 22. The actuator 22 traverses into the inner telescopic leg 17 and positioned adjacent to the angle adjustable mechanism 23. Furthermore, the actuator 22 is operatively coupled with the stator cylinder 20 and the linear actuated piston 21 in such a way that the operation of the actuator 22 allows the linear actuated piston 21 to retract and extend.

An alternative embodiment of the height adjustable mechanism 18 comprises a spring-loaded actuator, a releasable locking button, a plurality of fixed locking buttons, an alignment track, and an alignment channel. More specifically, the spring-loaded actuator is laterally and externally mounted to the outer tubular leg 13. The releasable locking button traverses into a sleeve opening of the outer tubular leg 13. The spring-loaded actuator is operatively coupled with the releasable locking button. Each of the plurality of fixed locking buttons is equally distributed along the inner telescopic leg 17. The alignment track is internally connected along the outer tubular leg 13, and the alignment channel traverses into the inner telescopic leg 17. Furthermore, the releasable locking button and the alignment track are diametrically opposed of each other about the outer tubular leg 13, and the plurality of fixed locking buttons and the alignment channel are diametrically opposed of each other about the inner telescopic leg 17. When the height adjustable mechanism 18 is actuated within the present invention, the releasable locking button selectively engages with one of the plurality of fixed locking button through the spring-loaded actuator as the alignment track and the alignment channel are slidably engaged with each other. In other words, when each of the plurality of fixed locking button applies an external force to the releasable locking button from the sleeve opening, the releasable locking button gets push into the body of the outer tubular leg 13 and away from the sleeve opening thus allowing the inner telescopic leg 17 to travel upward. However, when each of the plurality of fixed locking button does not apply external force on the releasable locking button from the sleeve opening, the spring-loaded actuator pushes the releasable locking button into the sleeve opening and away from the body of the outer tubular leg 13. As a result, the height adjustable mechanism 18 can lock the inner telescopic leg 17 and the outer tubular leg 13 with each other as the releasable locking button positions in between a pair of arbitrary button of the plurality of fixed locking button. When the inner telescopic leg 17 needs to be pushed down, travel downward, the user can manually pull the spring-loaded actuator from outside thus disengaging the connection between the releasable locking button and the plurality of fixed locking button. Due to gravitational force, the inner telescopic leg 17 then traverses into the outer tubular leg 13.

Figure 4:
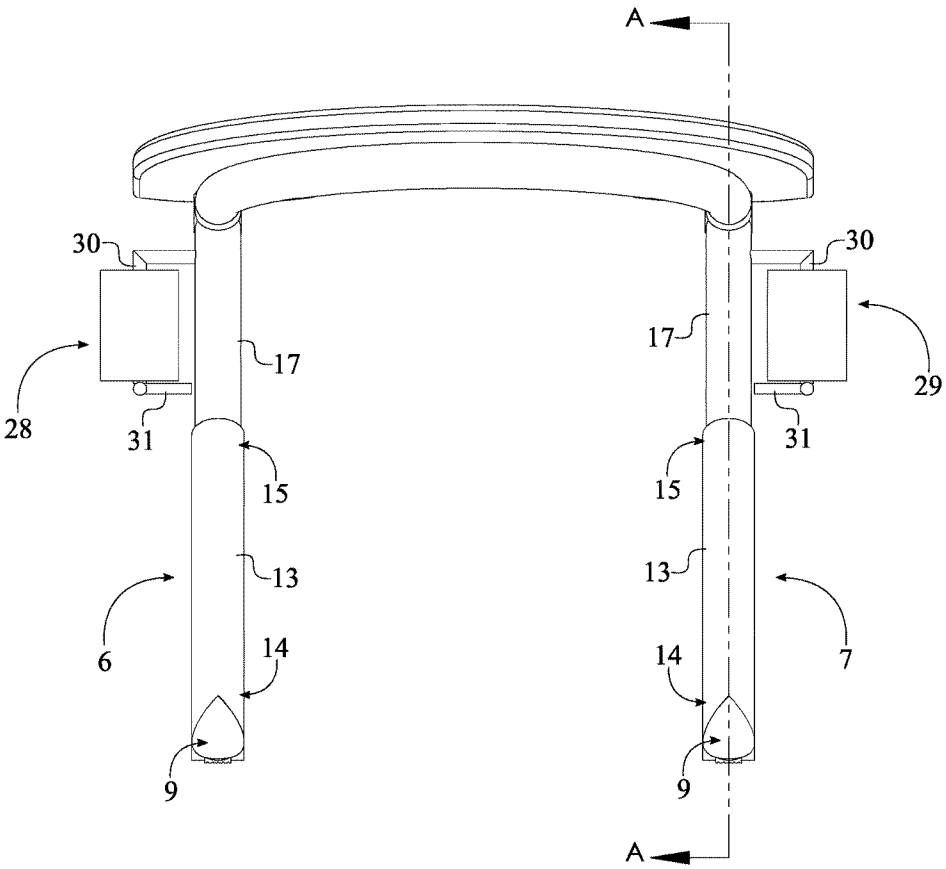
FIG. 4 is a front view of the present invention, showing the plane upon which a cross sectional view is taken shown in FIG. 5.

In reference to FIG. 4, the present invention further comprises a first toilet paper holder 28 and a second toilet paper holder 29. The first toilet paper holder 28 and the second toilet paper holder 29 each retains a toilet paper roll within the present invention so that the user can easily access the toilet paper rolls when necessary. More specifically, the first toilet paper holder 28 is connected to the inner telescopic leg 17 of the first leg assembly 6, and the second toilet paper holder 29 is connected to the inner telescopic leg 17 of the second leg assembly 7.

In reference to FIG. 4, The first toilet paper holder 28 and the second toilet paper holder 29 each comprise a L-shaped support 30 and a securing handle 31. The L-shaped support 30 is adjacently positioned to the platform 1 in such a way that L-shaped support 30 is laterally and terminally connected to the inner telescopic leg 17. In order to improve the safety parameters of the present invention, the L-shaped support 30 is oriented downward and towards the base leg 8. More specifically, a short leg of the L-shaped support 30 is connected to the inner telescopic leg 17, and a long leg of the L-shaped support 30 is oriented downward and towards the base leg 8 thus positioning normal to the bathroom floor. The securing handle 31 is hingedly and terminally connected to the L-shaped support 30, opposite of the inner telescopic leg 17, as the securing handle 31 can be oriented parallel or perpendicular to the long leg of the L-shaped support 30. When the toilet paper roll needs to be changed, the user can position the securing handle 31 parallel to the long leg of the L-shaped support 30 and remove the empty toilet paper roll from the first toilet paper holder 28 and the second toilet paper holder 29. After a new toilet paper roll is inserted around the long leg of the L-shaped support 30 through the securing handle 31, the securing handle 31 can be positioned perpendicular to the long leg of the L-shaped support 30. Resultantly, the perpendicularly positioned securing handle 31 and the short leg of the L-shaped support 30 secure the new toilet paper roll within the first toilet paper holder 28 and the second toilet paper holder 29.

The platform 1 provides the surface area to rest the user's feet and designed to positioned around the front of the western-style flush toilet. In reference to FIG. 1-2, the platform 1 comprises a support frame 2, a semi-circular plate 3, at least one left foot indicator 4, and at least one right foot indicator 5. The semi-circular plate 3 is connected atop the support frame 2 and oriented towards the user. The left foot indicator 4 terminally traverses into the semi-circular plate 3, opposite of the support frame 2. The right foot indicator 5 terminally traverses into the semi-circular plate 3, opposite of the support frame 2. Additionally, the left foot indicator 4 and the right foot indicator 5 are oppositely positioned of each other along the semi-circular plate 3. Due to the placement of the left foot indicator 4 and the right foot indicator 5, the user is able to clearly visualize where to place their feet by observing a top surface of the semi-circular plate 3. Furthermore, the least one left foot indicator 4 and the at least one right foot indicator 5 may further comprises an adult indicator and a child indicator to clearly illustrate feet positioning for different age group. The child indicator is positioned within the adult indicator as the parameter of the child indicator is less than the parameter of the adult indicator. The support frame 2 functions as the structural component between the first leg assembly 6 and the second leg assembly 7 to the semi-circular plate 3. More specifically, the support frame 2 is terminally mounted to the inner telescopic leg 17 of the first leg assembly 6 by the angle adjustable mechanism 23. The support frame 2 is terminally mounted to the inner telescopic leg 17 of the second leg assembly 7 by the angle adjustable mechanism 23, opposite of the first leg assembly 6.

In reference to FIG. 6, an orientation angle 32 between the platform 1 and an axis perpendicular to normal of the present invention, wherein the axis is also extended parallel to the base leg 8, is an acute angle within the present invention. Additionally, the angle adjustable mechanism 23 allows the orientation angle 32 to be altered according to the user's preference as the positioning angle of the platform 1 can change upon the hinged connection of the base leg 8 and the outer tubular leg 13. More specifically, the user can manually select the orientation angle 32 to be any angle between zero degrees and fifteen degrees through the angle adjustable mechanism 23. For example, when the present invention is utilized, the user can select the orientation angle 32 to be ten degrees through the angle adjustable mechanism 23.

Although the invention has been explained in relation to its preferred embodiment, it is to be understood that many other possible modifications and variations can be made without departing from the spirit and scope of the invention as hereinafter claimed.

What is claimed is:

1. A footstool for bathroom toilet to correct user's toilet posture comprises:

a platform;

a first leg assembly;

a second leg assembly;

the first leg assembly and the second leg assembly each comprise a base leg, an outer tubular leg, an inner telescopic leg, a height adjustable mechanism, and an angle adjustable mechanism;

a front end of the base leg being hingedly connected to a lower end of the outer tubular leg at an acute angle;

the inner telescopic leg being slidably engaged with an upper end of the outer tubular leg through the height adjustable mechanism;

the platform being terminally positioned to the inner telescopic leg of the first leg assembly and the inner telescopic leg of the second leg assembly, opposite of the upper end of the first leg assembly and the upper end of the second leg assembly; and the platform being mounted to the inner telescopic leg of the first leg assembly and the inner telescopic leg of the second leg assembly by the angle adjustable mechanism.

2. The footstool for bathroom toilet to correct user's toilet posture as claimed in claim 1 comprises:

the platform comprises a support frame, a semi-circular plate, at least one left foot indicator, and at least one right foot indicator;

the semi-circular plate being connected atop the support frame;

the left foot indicator terminally traverses into the semi-circular plate, opposite of the support frame;

the right foot indicator terminally traverses into the semi-circular plate, opposite of the support frame; and the left foot indicator and the right foot indicator being oppositely positioned of each other along the semi-circular plate.

3. The footstool for bathroom toilet to correct user's toilet posture as claimed in claim 1 comprises:

the platform comprises a support frame;

the support frame being terminally mounted to the inner telescopic leg of the first leg assembly by the angle adjustable mechanism; and the support frame being terminally mounted to the inner telescopic leg of the second leg assembly by the angle adjustable mechanism, opposite of the first leg assembly.

4. The footstool for bathroom toilet to correct user's toilet posture as claimed in claim 1 comprises:

a front friction pad;

a rear friction pad;

the front friction pad being positioned adjacent to the front end of the base leg;

the rear friction pad being positioned adjacent to a rear end of the base leg; and the front friction pad and the rear friction pad being externally connected onto the base leg.

5. The footstool for bathroom toilet to correct user's toilet posture as claimed in claim 1 comprises:

a locking brace;

the locking brace comprises a first support, a second support, and a locking mechanism;

the first support being hingedly connected to the base leg;

the second support being hingedly connected to the outer tubular leg; and the first support and the second support being pneumatically coupled with each other through the locking mechanism.

6. The footstool for bathroom toilet to correct user's toilet posture as claimed in claim 1 comprises:

a first toilet paper holder;

a second toilet paper holder;

the first toilet paper holder being connected to the inner telescopic leg of the first leg assembly; and the second toilet paper holder being connected to the inner telescopic leg of the second leg assembly.

7. The footstool for bathroom toilet to correct user's toilet posture as claimed in claim 6 comprises:

the first toilet paper holder and the second toilet paper holder each comprise a L-shaped support and a securing handle;

the L-shaped support being adjacently positioned to the platform;

the L-shaped support being laterally and terminally connected to the inner telescopic leg; and the securing handle being hingedly and terminally connected to the L-shaped support, opposite of the inner telescopic leg.

8. The footstool for bathroom toilet to correct user's toilet posture as claimed in claim 1, wherein an orientation angle between the platform and the inner telescopic leg is an acute angle.

9. The footstool for bathroom toilet to correct user's toilet posture as claimed in claim 8, wherein the angle adjustable mechanism rotates from zero degrees to fifteen degrees.

10. The footstool for bathroom toilet to correct user's toilet posture as claimed in claim 1 comprises:

the height adjustable mechanism comprises a pneumatic lifting assembly and an actuator;

a stator cylinder of the pneumatic lifting assembly being concentrically connected within the outer tubular leg;

a linear actuated piston of the pneumatic lifting assembly being concentrically connected within the inner telescopic leg;

the stator cylinder and the linear actuated piston being pneumatically coupled with each other;

the actuator traverses into the inner telescopic leg, adjacent to the angle adjustable mechanism; and the actuator being operatively coupled with the stator cylinder and the linear actuated piston, wherein the operation of the actuator allows the linear actuated piston to retract and extend.

* * * * *